US009297141B2

(12) United States Patent
Hill

(10) Patent No.: US 9,297,141 B2
(45) Date of Patent: Mar. 29, 2016

(54) COUPLER

(71) Applicant: Ian Hill, Newry (GB)

(72) Inventor: Ian Hill, Newry (GB)

( * ) Notice: Subject to any disclaimer, the term of this patent is extended or adjusted under 35 U.S.C. 154(b) by 36 days.

(21) Appl. No.: 14/252,288

(22) Filed: Apr. 14, 2014

(65) Prior Publication Data

US 2014/0219714 A1 Aug. 7, 2014

Related U.S. Application Data

(63) Continuation of application No. 12/905,175, filed on Oct. 15, 2010, now abandoned.

(30) Foreign Application Priority Data

Oct. 16, 2009 (GB) ..... 0918139.7
Jun. 18, 2010 (GB) ..... 1010270.5

(51) Int. Cl.
*F16D 1/08* (2006.01)
*F16D 3/80* (2006.01)
(Continued)

(52) U.S. Cl.
CPC ..... *E02F 3/3622* (2013.01); *E02F 3/365* (2013.01); *E02F 3/3618* (2013.01);
(Continued)

(58) Field of Classification Search
CPC ..... E02F 3/3618; E02F 3/3622; E02F 3/3663; E02F 9/2267; E02F 9/2271; F15B 13/0405; F16K 15/04; Y10T 403/59; Y10T 403/591; Y10T 403/593; Y10T 403/595; Y10T 403/598; Y10T 403/602; Y10T 403/608; Y10T 403/22
USPC ..... 403/321, 322.1, 322.3, 322.4, 324, 327, 403/330, 31; 37/468; 172/272, 273, 274, 172/275; 414/705, 723
See application file for complete search history.

(56) References Cited

U.S. PATENT DOCUMENTS 1,085,964 A 2/1914 Briggs
2,056,006 A 9/1936 Hodgkins
(Continued)

FOREIGN PATENT DOCUMENTS

EP 1892137 A1 8/2007
FR 978531 4/1951
(Continued)

OTHER PUBLICATIONS

European Search Report for EP 04008658 mailed Aug. 19, 2004.
(Continued)

*Primary Examiner* — Gregory Binda
*Assistant Examiner* — Nahid Amiri
(74) *Attorney, Agent, or Firm* — Gardner, Linn, Burkhart & Flory, LLP

(57) ABSTRACT

A coupler for an excavator or other apparatus comprising a body for receiving an excavator attachment; a first latch member movable into and out of a latching state in which it is capable of retaining the attachment on the body. The first latch member being movable into and out of the latching state by an actuator, wherein a gravity operated valve is associated with the actuator. The valve has a first state wherein fluid can flow through the valve as the latch member is moved out of its latching state, and a second state, wherein fluid is prevented from flowing through the valve thus preventing operation of the actuator to move the latch member out of its latching state. The valve is adapted to adopt the first state when the coupler is in a non-working orientation and the second state when the coupling is in a working orientation.

15 Claims, 4 Drawing Sheets

(51) Int. Cl.

| | |
|---|---|
| ***F16L 17/00*** | (2006.01) |
| ***E02F 3/36*** | (2006.01) |
| ***E02F 9/22*** | (2006.01) |
| ***F15B 13/04*** | (2006.01) |

(52) U.S. Cl.

CPC ..... *E02F 3/3663* (2013.01); *E02F 9/2267* (2013.01); *E02F 9/2271* (2013.01); *F15B 13/0405* (2013.01); *Y10T 403/22* (2015.01); *Y10T 403/7075* (2015.01)

(56) References Cited

U.S. PATENT DOCUMENTS

| | | | | |
|---|---|---|---|---|
| 2,090,795 | A * | 8/1937 | Johnson | 123/90.57 |
| 2,932,282 | A | 1/1945 | McKinley et al. | |
| 2,366,587 | A | 4/1960 | Armington | |
| 3,414,136 | A | 12/1968 | Moore et al. | |
| 3,940,931 | A | 3/1976 | Renfro et al. | |
| 4,269,213 | A | 5/1981 | Sasaki | |
| 4,577,885 | A | 3/1986 | Breu | |
| 4,748,570 | A | 5/1988 | Shochi et al. | |
| 5,052,429 | A | 10/1991 | Yoo | |
| 5,239,919 | A | 8/1993 | Maki et al. | |
| 5,355,676 | A | 10/1994 | Inokuchi | |
| 5,423,625 | A | 6/1995 | Gebauer et al. | |
| 5,617,771 | A | 4/1997 | Landrum | |
| 5,748,077 | A | 5/1998 | Brandt | |
| 6,132,131 | A | 10/2000 | Nakamura et al. | |
| 6,173,572 | B1 | 1/2001 | Cobo et al. | |
| 6,273,128 | B1 | 8/2001 | Paczonay | |
| 6,286,412 | B1 | 9/2001 | Manring et al. | |
| 6,295,810 | B1 | 10/2001 | Langen et al. | |
| 6,332,747 | B1 | 12/2001 | Lee | |
| 6,379,075 | B1 | 4/2002 | Shamblin et al. | |
| 6,422,805 | B1 | 7/2002 | Miller | |
| 6,481,124 | B1 | 11/2002 | Miller et al. | |
| 6,579,263 | B1 | 6/2003 | Chernack | |
| 6,902,346 | B2 | 6/2005 | Steig, Jr. et al. | |
| 7,018,159 | B2 | 3/2006 | Jordan et al. | |
| 7,047,866 | B2 | 5/2006 | Fatemi et al. | |
| 7,306,395 | B2 | 12/2007 | Fatemi | |
| 7,426,796 | B2 | 9/2008 | Cunningham et al. | |
| 7,493,712 | B2 | 2/2009 | McCormick et al. | |
| 7,549,243 | B1 | 6/2009 | Gilles | |
| 7,620,522 | B2 | 11/2009 | Bredau et al. | |
| 7,648,305 | B2 | 1/2010 | Beales | |
| 7,797,862 | B2 | 9/2010 | Daraie et al. | |
| 7,984,575 | B2 | 7/2011 | Robl et al. | |
| 7,984,576 | B2 | 7/2011 | Miller et al. | |
| 8,136,353 | B2 | 3/2012 | Dybing | |
| 2002/0071754 | A1 | 6/2002 | Fatemi | |
| 2003/0010198 | A1 | 1/2003 | Fuss et al. | |
| 2004/0255774 | A1 | 12/2004 | Hill | |
| 2005/0169703 | A1 | 8/2005 | Fatemi | |
| 2005/0214105 | A1 | 9/2005 | Steig, Jr. et al. | |
| 2006/0254641 | A1 | 11/2006 | Callahan et al. | |
| 2007/0157492 | A1 | 7/2007 | Miller et al. | |
| 2007/0166143 | A1 | 7/2007 | Hart et al. | |
| 2007/0199214 | A1 | 8/2007 | McCormick et al. | |
| 2008/0099072 | A1 | 5/2008 | Engdahl | |
| 2009/0282712 | A1 | 11/2009 | Pruszynski | |
| 2010/0061799 | A1 | 3/2010 | Hill | |
| 2010/0067982 | A1 | 3/2010 | Hill | |
| 2011/0088795 | A1 | 4/2011 | Hill | |
| 2011/0091267 | A1 | 4/2011 | Hill | |
| 2011/0243654 | A1 | 10/2011 | Hill | |
| 2012/0177472 | A1 | 7/2012 | Hill | |

FOREIGN PATENT DOCUMENTS

| | | | |
|---|---|---|---|
| FR | 1146273 | | 11/1957 |
| FR | 2914932 | A1 | 10/2008 |
| GB | 897384 | | 5/1962 |
| GB | 1586621 | | 3/1981 |
| GB | 2330570 | A | 4/1999 |
| GB | 2332417 | A | 6/1999 |
| GB | 2 420 109 | A | 5/2006 |
| GB | 2450127 | A | 12/2008 |
| JP | 57155168 | A | 9/1982 |
| KR | 20010019689 | A1 | 3/2001 |
| NZ | 220557 | A | 2/1991 |
| WO | WO 97/03000 | | 1/1997 |
| WO | WO 98/40569 | A1 | 9/1998 |
| WO | WO 2004/072387 | A1 | 8/2004 |
| WO | WO 2005/026454 | A1 | 3/2005 |
| WO | WO 2008/031590 | A2 | 3/2008 |
| WO | WO 2011/035883 | A1 | 3/2011 |

OTHER PUBLICATIONS

International Search Report for PCT Application No. PCT/EP2007/007974 mailed May 27, 2008, which is the international counterpart to U.S. Appl. No. 12/440,948.

Written Opinion of the International Searching Authority for PCT Application No. PCT/EP2007/007974, which is the international counterpart to U.S. Appl. No. 12/440,948.

European Search Report completed Nov. 20, 2009, which is a foreign counterpart to U.S. Appl. No. 12/555,476.

* cited by examiner

COUPLER

CROSS REFERENCE TO RELATED APPLICATION

The present application is a continuation of U.S. patent application Ser. No. 12/905,175 filed Oct. 15, 2010, which claims the benefit of foreign applications GB0918139.7 filed on Oct. 16, 2009 and GB1010270.5 filed on Jun. 18, 2010, by Ian Hill for COUPLER, which are all hereby incorporated herein by reference in their entireties

FIELD OF THE INVENTION

This invention relates to a coupler for connecting and disconnecting attachments, such as buckets, to the arm of an excavator or backhoe or the like and to a control system therefor.

BACKGROUND TO THE INVENTION

Hydraulic couplers for quickly connecting and disconnecting attachments, such as buckets, from excavating and construction equipment are well known. Such attachments are usually attached to an arm of the excavator using two spaced and parallel pins provided on the attachment, wherein one of the pins is generally located in an open-mouthed substantially C-shaped aperture or recess of the coupling and the other pin is located in a similar C-shaped aperture or recess, one or both of the pins being secured within the respective C-shaped aperture by means of a movable jaw or latch member. The C-shaped apertures are arranged such that when the first pin is located in the first aperture and the second pin is secured in the second aperture and the or each latch member is closed the attachment is securely held by the coupling. Typically the or each moveable latch member is moved between an open and a closed position by means of a double acting hydraulic ram driven by a hydraulic circuit operated by a hydraulic control system.

When it is desired to remove, attach or replace an attachment from the arm of the excavator the arm is typically oriented so that the coupling is in a non-working orientation wherein that the bucket rests on the ground before the actuator is operated to move the or each latch member to its open position so that the arm can then be detached from the bucket. It is desirable to prevent opening of the latch member at any other time because release of the hydraulic coupling when in a working orientation while the attachment is suspended from the arm can cause the attachment to swing or even completely detach from the coupler, posing a serious safety hazard.

It is known to provide a gravity operated blocking member that is movable under the action of gravity between a first position, when the coupling is in its non-working orientation, permitting movement of the latch member from its closed to its open position, and a second position, when the coupling is in its working position, wherein movement of the latch member from its closed position is prevented by the blocking member. However, due to the conditions in which the excavator is used, such blocking members are prone to sticking or damage and may malfunction, allowing the latch member to move to its open position when the coupling is in its working orientation.

SUMMARY OF THE INVENTION

According to a first aspect of the present invention there is provided a coupler for an excavator or other apparatus, the coupler comprising a body for receiving an excavator attachment; a first latch member movable into and out of a latching state in which it is capable of retaining the attachment on said body; said first latch member being movable into and out of said latching state by means of a hydraulic or pneumatic actuator, wherein a gravity operated valve, for example a non-return valve, is associated with the actuator, said valve having a first state, wherein fluid can flow through the valve as the latch member is moved out of its latching state, and a second state, wherein fluid is prevented from flowing through the valve thus preventing operation of the actuator to move the latch member out of its latching state, said valve being adapted to adopt said first state when the coupler is in a non-working orientation and said second state when the coupling is in a working orientation.

Preferably said valve comprises a flow passage in a hydraulic circuit of the actuator, a portion of said flow passage defining a valve seat, a valve stop member being provided within the flow passage, said valve stop member being out of said valve seat when the valve is in its first state, allowing fluid to flow through said flow passage, said valve stop member being located in the valve seat when the valve is in its second state, preventing the flow of fluid through said flow passage, said valve stop member being moveable within said flow passage into and out of said valve seat under the action of gravity. The valve stop member may comprise a ball. Said valve seat may comprise a reduced diameter portion of said flow passage, for example a tapered portion of said flow passage. Said flow passage may comprise one or more passage sections, each of which may be straight or curved. One or more of said passage sections may form all or part of the valve seat. In one embodiment, the flow passage comprises a single straight passage having a valve seat at one end. In another embodiment, the flow passage is substantially L-shaped, with one section of said L-shape providing part of said valve seat.

The gravity operated valve may be incorporated into the retract line of a fluidic circuit for operating the actuator such that, in one or more orientations of the actuator, the gravity operated actuator adopts its second state under the influence of gravity to prevent said actuator from being retracted.

The gravity operated valve may be incorporated into the extend line of a fluidic circuit for operating the actuator such that, in one or more orientations of the actuator, the gravity operated actuator adopts its second state under the influence of gravity to prevent said actuator from being retracted.

The coupler may further comprise a control system for the actuator, said control system comprising a source of pressurised fluid, such as a pump, a low pressure drain or reservoir, and a switch over valve, or other switching means, being operable between a first state, wherein said source of pressurised fluid is connected to an extend line connected to an extend side of the actuator to extend the actuator, and a second state, wherein pressurised fluid is supplied to a retract line connected to a retract side of the actuator to retract the actuator, said retract line being connected to said low pressure drain or reservoir when the switch over valve, or other switching means, is in its first state and said extend line being connected to said low pressure drain or reservoir when the switch over valve, or other switching means, is in its second state.

In one embodiment said gravity operated non-return valve being provided in or being associated with said retract line whereby the valve prevents fluid from flowing through the retract line to retract side of the actuator when the switch over valve, or other switching means, is in its second state and when the gravity operated valve is in its second state, thus preventing retraction of the actuator when the coupling is in a working orientation.

Alternatively said gravity operated valve being provided in or being associated with said extend line whereby the valve prevents a return flow of fluid through the extend line to the low pressure drain or reservoir when the switch over valve, or other switching means, is in its second state and when the gravity operated valve is in its second state, thus preventing retraction of the actuator when the coupling is in a working orientation by preventing the escape of fluid from the extend side of the actuator as pressurised fluid is supplied to the retract side of the actuator Preferably said gravity operated valve is provided on or in said actuator, for example within a fluid supply manifold mounted on, or integrally formed within the actuator. Said flow passage of the valve may comprise a drilling within the fluid supply manifold. Alternatively, said gravity operated valve may be provided on the coupler body, or on the excavator or other apparatus to which the coupler is attached.

The coupler may further comprise a second latch member movable into and out of a latching state in which it is capable of retaining a respective attachment pin in said second recess; said fluid operated actuator being operable to move said second latch member into and out of said latching state. The actuator may extend between the first and second latch members to simultaneously move said first and second latch members into and out of their respective latching states.

According to a further aspect of the present invention there is provided a double acting hydraulic ram assembly comprising a cylinder, or housing, within which a piston mounted upon an end of a piston rod is reciprocally moveable between extended and retracted positions, an extend line communicating with the cylinder on an extend side of the piston for supplying pressurised fluid into said extend side of to move the piston and piston rod to its extended position and a retract line communicating with the cylinder on a retract side of the piston for supplying pressurised fluid into said retract side to move the piston and piston rod to its retracted position, said assembly including a gravity operated valve, especially a non-return valve, associated with one of the extend or retract lines, said valve having a first state when the ram is in a first orientation, wherein fluid can flow through the valve permitting the flow of pressurised fluid into the cylinder to move the piston towards its extended and/or retracted positions, and a second state when the ram is in a second orientation, wherein fluid is prevented from flowing through the valve thus preventing actuation of the ram.

In one embodiment the valve is provided in or associated with the retract line preventing pressurised fluid from passing into the retract side of the cylinder when the valve is in its second state.

Preferably said non-return valve comprises a flow passage having a reduced diameter portion defining a valve seat, a valve member being provided within the flow passage, said valve member being spaced from said valve seat when the valve is in its first state, allowing fluid to flow through said flow passage, said valve member being located against the valve seat when the valve is in its second state, preventing the flow of fluid through said flow passage, said valve member being moveable within said flow passage towards and away from said valve seat under the action of gravity. The valve member may comprise a ball, said valve seat comprising a tapered portion of said flow passage.

BRIEF DESCRIPTION OF THE DRAWINGS

An embodiment of the present invention will now be described, by way of example only, with reference to the accompanying drawings, in which.

DETAILED DESCRIPTION OF THE DRAWINGS

Figure 1:
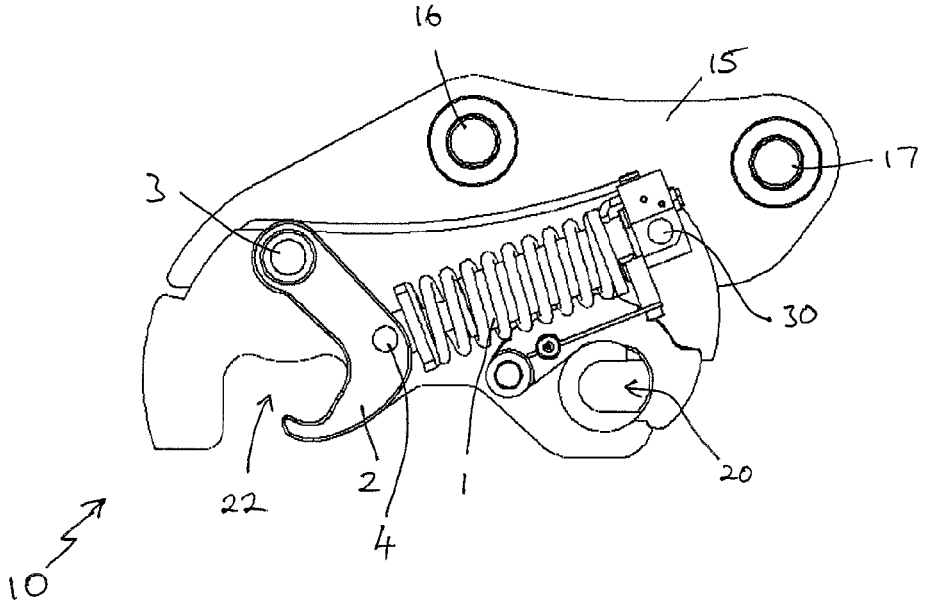
FIG. 1 is a side view of a coupler for an excavator.

FIG. 1 illustrates, by way of example, a coupler with which the present invention is suitable for use. It is noted that the invention is not limited to use with the coupler shown in FIG. 1 and the invention is suited for use with any coupler employing hydraulics to release the latching mechanism.

Referring now to the drawings there is shown, generally indicated as 10, as an example of a coupler, or hitch, for connecting a tool, or other attachment such as a bucket, to an arm of an excavator (not shown), or other apparatus. The coupler 10 has a body typically comprising two spaced-apart side plates 15 (only one shown). The body is shaped to define pin-receiving apertures 16, 17 by which the coupler 10 may be connected to the end of the arm. Typically, there are two spaced-apart apertures 16, 17 in each of the two side plates 15, the apertures in one side plate being aligned with the apertures in the other. When connected, the coupler 10 is able to pivot with respect to the arm about the axis of the apertures 17. Usually, a hydraulic mechanism, or other power operated mechanism (not shown), is provided, typically in association with a mechanical linkage and connected via aperture 16, to pivot the coupler 10 with respect to the arm.

The body includes first and second pin-receiving recesses 20, 22 formed in each side plate 15. Each recess 20, 22 is shaped and dimensioned to receive a respective pin of a bucket or other attachment. Normally, the recesses 20, 22 face in mutually perpendicular directions. The recess 22 may be wider than is necessary to receive a single pin in order to accommodate attachments with different pin spacings.

The coupler 10 also includes a power-operated latching mechanism typically comprising a latching member 2, in the preferred form of a hook, and an actuator 1 typically in the form of a linear actuator such as a hydraulic ram, especially a double-acting hydraulic ram. Other forms of powered actuator could be used (e.g. pneumatic or electrically operated) but hydraulic is convenient because excavators typically have a hydraulic system available at or near the end of the arm. The latching member 2 and actuator 1 are provided between the side plates 15. The latching member 2, which may comprise one or more aligned hook elements, is pivotally mounted on the body at pivot 3 in any convenient manner and is pivotable about an axis that runs substantially perpendicular to the body/plates 15. The latching member 2 is pivotable between an open, or non-latching, state and at least one latching state. In the open state, the latching member 2 allows a respective pin to be inserted into or removed from the recess 22. In the latching state, the latching member 2 prevents the pin from being removed from the recess 22. For example, in FIG. 1, the latching member 2 is shown in its latching state.

Typically, the actuator 1 comprises a piston housing (commonly referred to as a "cylinder", although it does not necessarily have to be cylindrical in shape) and a piston rod, the rod being actuatable into and out of the housing in a reciprocating manner. In the preferred embodiment, the free, or leading, end of the piston rod is pivotably connected to the latching member 2, the pivoting movement being about a respective axis 4 that is substantially perpendicular to the plates 15. A rear end of the piston housing is pivotably connected to the housing for pivotal movement about a respective pivot axis 30 adjacent the recess 20. When the piston rod adopts a retracted state, or relatively retracted state, the latching member 2 adopts its open state. When the piston rod is extended, the latching member 2 moves towards its latching state. Depending on the location of the respective pin in the recess 22, the amount by which the piston rod is extended when the latching member 2 reaches its latching state can vary. Conveniently, the actuator 1 is operable via the excavator's hydraulic system (not shown), the controls typically being located in the cab of the excavator.

During use, the coupler 10 may adopt a number of different working orientations in which it may, for example, be substantially horizontally disposed, inclined with respect to horizontal, or even substantially vertically orientated. When the coupler is working, for reasons of safety, it is desirable that the operator cannot cause the latching member 2 to be retracted. However, the operator should be able to release the attachment when it is desired to change the attachment. Ideally, the operator should be forced to cause the coupler to adopt a "non-working" orientation before he is able to retract the latching member. Preferably, in a non-working orientation, the attachment can be released such that there is little or no danger that the attachment will fall in an uncontrolled manner. For couplers of the type shown in FIG. 1, suitable non-working orientations of the coupler correspond to orientations where the hook-like recess 20 is able to retain its attachment pin under the influence of gravity, e.g. when the coupler is substantially vertical with the recess 20 facing upwards, or other orientation where the open end of the recess 20 faces generally upwards.

In alternative embodiments, the or each latch member may be slidably mounted on the body of the coupling, or otherwise movable between the open state and the latching state(s), without necessarily being pivotable.

Figure 2:
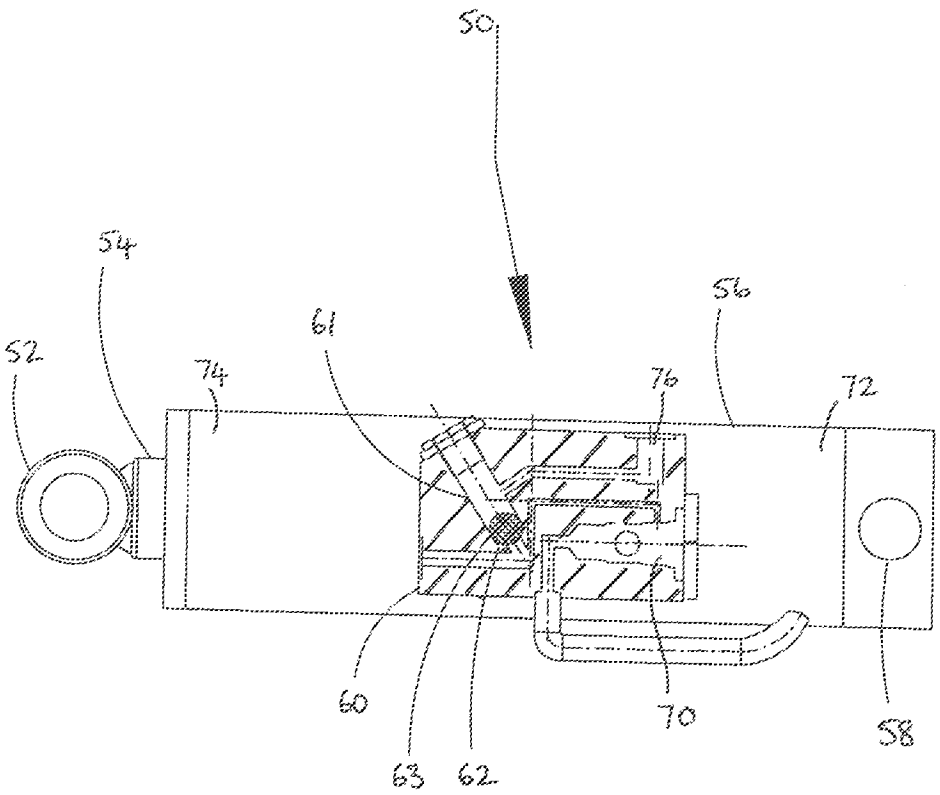
FIG. 2 is sectional view through a supply manifold block of a double acting hydraulic ram of a coupler for an excavator according to an embodiment of one aspect of the present invention.
Figure 3:
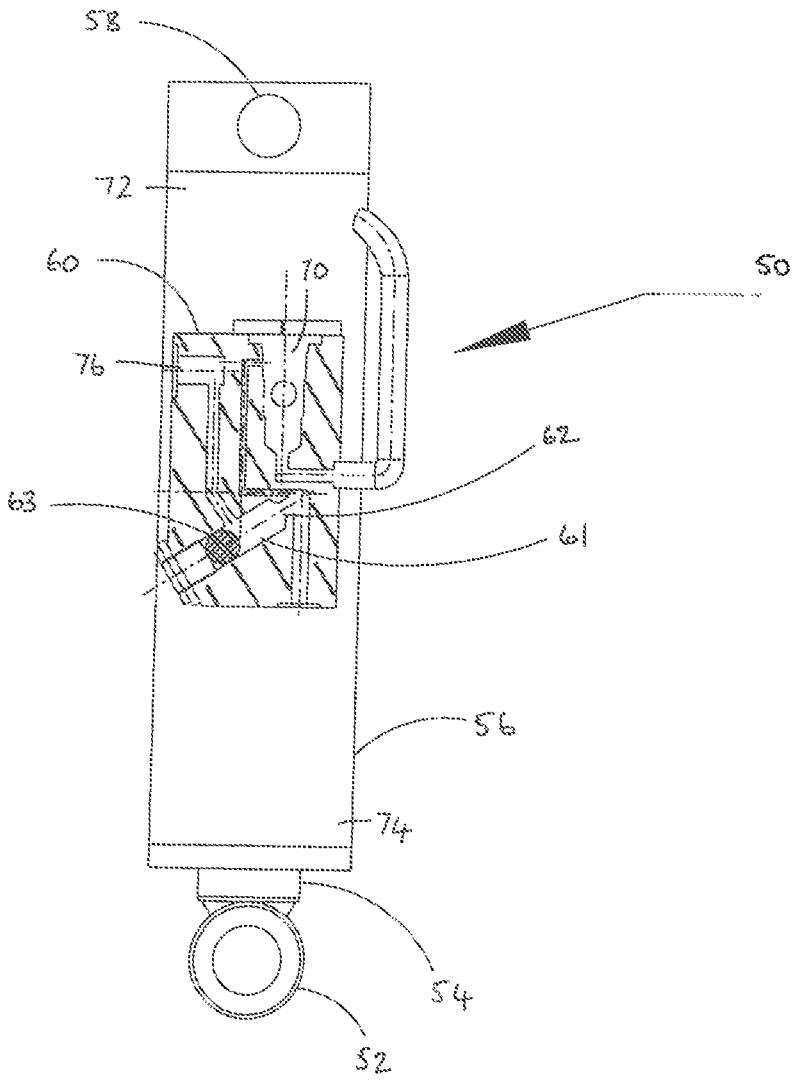
FIG. 3 is an another view of the manifold block and coupler of FIG. 2, shown in a different orientation.

Referring now to FIGS. 2 and 3, a linear actuator 50, in the preferred form of a double-acting hydraulic ram is shown, as a first embodiment of one aspect of the invention, and being suitable for use as the actuator 1 a coupler. The ram 50 has a free end 52 of its piston rod 54 which is pivotably connectable to, for example, the latch member 2. The opposite end 58 of the housing, or cylinder 56, being pivotably connectable to the body of the coupler or to a second latch member, or otherwise pivotable with respect to the coupler body. When the piston rod 54 adopts a retracted state (FIG. 2), the or each latch member 2 adopts its open state. When the piston rod 54 is extended, the or each latch member moves towards its latching state. Conveniently, the ram 50 is operable via the excavator's hydraulic system (not shown), the controls typically being located in the cab of the excavator.

The ram 50 is connected in use to a hydraulic circuit for operating the coupler to move the or each latch member between its latched and open states and to maintain the or each latch member in its selected state. High pressure fluid, typically oil, is supplied to the coupler operating ram 50 by a pump. The oil typically flows though a non return valve and a flow restrictor into an inlet port of a solenoid actuated switching valve (not shown).

When it is desired to extend the ram, the hydraulic circuit is configured so that oil flows through from an extend line of the hydraulic circuit into a port 70 and into an extend side 72 of the cylinder 56 of the ram 50. This flow of oil into the cylinder 56 causes the piston (not visible) of the ram to move, extending the piston rod 54. Oil from the opposite side 74 of the piston returns to a tank or reservoir via a retract line (not shown) connected to a retract port 76 of the cylinder 56 until the piston rod 54 reaches the end of its stroke.

When it is desired to retract the ram 50, the hydraulic circuit is configured such that oil from the pump flows through retract line into the retract side 74 of the cylinder 56 via port 76. Oil from the extend side 72 of the cylinder 56 returns to the reservoir via the extend line and port 70. This flow of oil into the retract side 74 of the cylinder causes piston rod 54 to retract.

Typically, the extend and return lines of the hydraulic circuit are connected to the ram 50 via a supply manifold block 60 mounted on the cylinder 56. Alternatively, the manifold block 60 could be incorporated into the cylinder 56, or mounted on the body of the coupler, or even mounted on an arm of the apparatus, e.g. excavator, to which the coupler is coupled.

A channel or passage 61 is provided in the manifold block 60 for receiving a movable valve stop 63 in the preferred form of a ball. The passage 61 and valve stop 63 together form a gravity operable valve for controlling the flow of oil into and/or out of the cylinder 56. Conveniently, the passage 61 is formed by an extra drilling within the supply manifold 60. Alternatively, the gravity-operated valve may take a different form, e.g. a separate self-contained valve. The valve has a seat 62, typically a tapered seat, and a free floating ball 63 arranged such that when the ball 63 is sitting on the seat 62 flow of oil past the ball 63 is prevented. The movement of the ball 63 onto and off the seat 62, i.e. into and out of the closed position of the valve, is performed by the action of gravity upon the ball 63. Accordingly, when the ram 50 is incorporated into a coupler, the orientation of the coupler determines whether or not the valve stop 63 is in its seat 62. The orientation of the passage 61 with respect to the ram 50 is selected such that in certain orientations of the coupler, and in particular in working orientations of the coupler, the ball 63 rests upon the seat 62 and prevents the passage of oil, in this case into the retract side 74 of the cylinder 56 (see FIG. 2). In other orientations of the coupler, and in particular in non-working orientations of the coupler, the ball 63 falls out of the seat 62 to allow oil to pass (see FIG. 3), in this case into the retract side 74 of the cylinder 56. The gravity operated valve is preferably incorporated into the retract line of the cylinder and thus will directly prevent the retraction of the cylinder in certain orientations of the cylinder, preventing release of the attachment when in use. Alternatively, the gravity operated valve could be incorporated into the extend line of the cylinder (e.g. between port 70 and the extend side 72) and arranged to prevent oil from leaving the extend side in certain orientations of the cylinder (and thus to prevent a retraction of the piston rod 54). When the ram 50 is fitted to a coupler it prevents the retraction of the ram 50 in certain orientations of the coupler and thus prevent retractions of the first and/or second latch member from adopting its open state in certain orientations of the coupler.

Advantageously, the orientation of the passage 61 with respect to the ram 50, and hence the influence of gravity upon the ball 63, is selected such that retraction of the cylinder, and accordingly the withdrawal of the or each latch member, is prevented where the attitude of the coupler would allow the attachment to fall from the front jaw of the coupler under the influence of gravity. That is to say that the retraction of the cylinder can only take place with the coupler in an attitude where the front pin of the attachment is retained within the front jaw of the coupler by the action of gravity, typically referred to as a non-working orientation of the coupling.

In cases where the gravity operated valve is not mounted on the ram itself, e.g. where the manifold 60 is mounted on the coupler, or the apparatus to which the coupler is attached, or some other item, the orientation of the passage 61 is selected relative to the various orientations that the respective item may take in order to achieve the desired position of the valve stop 63 in ach orientation.

As well as, or instead of, selecting the orientation of the valve passage to achieve the desired operation of the gravity operated valve, the shape of the passage may be selected for this purpose. For example, in the embodiment of FIGS. 2 and 3, the passage 61 comprises a single straight passage. However, the passage may alternatively comprise two or more interconnected passage sections obliquely or perpendicularly disposed with respect to one another. Alternatively, or in addition, the passage or passage section(s) may be curved rather than straight.

Figure 4:
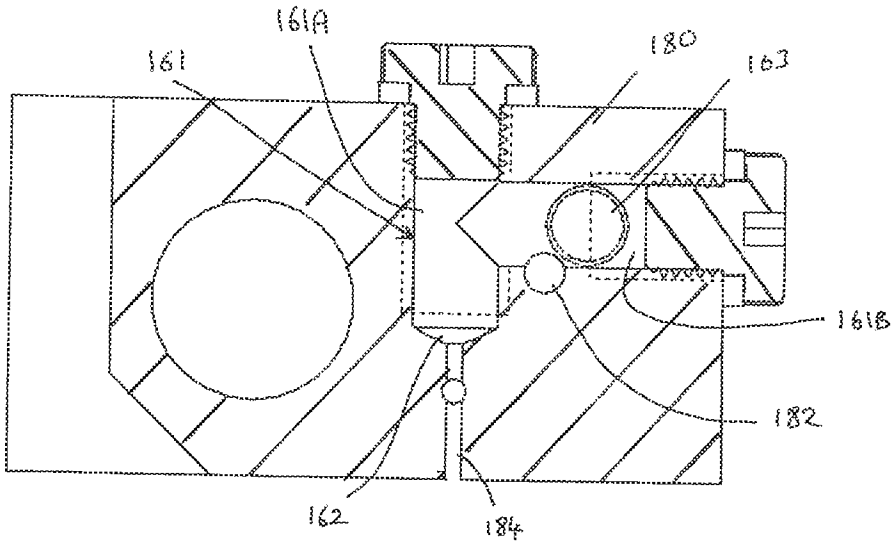
FIG. 4 is a section view of an alternative manifold block incorporating an alternative embodiment of a gravity-operated valve.

By way of example, FIG. 4 shows an alternative gravity operated valve 180 that is suitable for use with a ram and a coupler as described above. The valve 180 has a valve stop 163, gain conveniently a free floating ball, movable in a passage 161 that comprises two sections 161A, 161B and a valve seat 162. A fluid inlet 182 allows oil into the passage 161 and a fluid outlet 184 allow fluid out of the passage 161 when the ball 163 is not in its seat 162. Preferably, the sections 161A, 161B are perpendicular to one another to create an L-shaped passage 161. It will be seen that the ball 163 can prevent fluid from reaching the outlet not only when in its seat 162, but also when it is in the section 161A of the passage. Effectively, the section 161A has become part of the valve seat for the ball 163. The L-shaped passage affects the way in which the gravity operated valve works in comparison to the passage 61 of FIGS. 2 and 3. For example, with the passage 61 of FIGS. 2 and 3, the ball 63 may fall out of its seat 62 if the ram 50 is rotated through approximately 45 degrees or more (anticlockwise as viewed in FIG. 2) from the orientation of FIG. 2. In contrast, with the passage 161 of FIG. 4, the ball 163 is not clear of the inlet in section 161B (i.e. in the position shown in FIG. 4) until the ram is rotated through approximately 180 degrees or more (anticlockwise as viewed in FIG. 4) from the orientation of FIG. 4.

It will be apparent that rams using the gravity operated valve described herein are not restricted for use with couplers.

The invention is not limited to the embodiment(s) described herein but can be amended or modified without departing from the scope of the present invention.

The invention claimed is:

1. A coupler for an excavator, the coupler comprising a body for receiving an excavator attachment; a first latch member movable into and out of a latching state in which it is capable of retaining the attachment on said body; said first latch member operatively connected with said body and being movable into and out of said latching state by means of a hydraulic or pneumatic actuator, wherein a gravity operated valve is associated with the actuator, said valve having a first state, wherein fluid can flow through the valve as the latch member is moved out of its latching state, and a second state, wherein fluid is prevented from flowing through the valve thus preventing operation of the actuator to move the latch member out of its latching state, said valve being adapted to adopt said first state when the coupler is in a non-working orientation and said second state when the coupler is in a working orientation, wherein said valve comprises a flow passage in a hydraulic circuit of the actuator having a fluid inlet and a fluid outlet, a portion of said flow passage defining a valve seat located between said fluid inlet and said fluid outlet, a valve stop member in the form of a ball being provided within the flow passage, said valve stop member being out of said valve seat under the action of gravity when the valve is in its first state due to rotation of the coupler to its non-working orientation, allowing fluid to flow through said flow passage between the fluid inlet and the fluid outlet, said valve stop member being located in the valve seat under the action of gravity when the valve is in its second state due to rotation of the coupler into its working orientation, preventing the flow of fluid between the fluid inlet and the fluid outlet, said valve stop member being moveable within said flow passage into and out of said valve seat under the action of gravity, wherein the flow passage is substantially L-shaped having first and second sections arranged perpendicular to one another, the fluid inlet being provided in a side wall of said first section of the flow passage and the fluid outlet being provided at one end of the second section of the flow passage, said valve seat being provided at said one end of the second section upstream of the fluid outlet.

2. The coupler as claimed in claim 1, wherein the diameter of at least the second section of the flow passage is substantially equal to the diameter of the stop member such that fluid flow between the fluid inlet and the fluid outlet of the flow passage is prevented by the stop member when the stop member is located within the second section of the flow passage.

3. The coupler as claimed in claim 2, wherein the gravity operated valve is incorporated into the retract line of the hydraulic circuit for operating the actuator such that, in one or more orientations of the actuator, the gravity operated actuator adopts its second state under the influence of gravity to prevent said actuator from being retracted.

4. The coupler as claimed in claim 2, wherein the gravity operated valve is incorporated into the extend line of the hydraulic circuit for operating the actuator such that, in one or more orientations of the actuator, the gravity operated actuator adopts its second state under the influence of gravity to prevent said actuator from being retracted.

5. The coupler as claimed in claim 1, wherein said gravity operated valve is provided on or in said actuator.

6. The coupler as claimed in claim 5, wherein said gravity operated valve is provided within a fluid supply manifold mounted on, or integrally formed within the actuator.

7. The coupler as claimed in claim 6, wherein said flow passage of the valve comprises drillings within the fluid supply manifold.

8. The coupler as claimed in claim 1, wherein said gravity operated valve is provided on the coupler body, or on the excavator or other apparatus to which the coupler is attached.

9. The coupler as claimed in claim 1, wherein the body is provided with first and second spaced apart recesses for receiving respective pins of said excavator attachment, said first latch member retaining a respective attachment pin in said first recess when in its latching state.

10. The coupler as claimed in claim 9, wherein the coupler further comprises a second latch member movable into and out of a latching state in which it is capable of retaining a respective attachment pin in said second recess, said actuator extending between the first and second latch members to simultaneously move said first and second latch members into and out of their respective latching states.

11. The coupler as claimed in claim 1, wherein the gravity operated valve is incorporated into the retract line of the hydraulic circuit for operating the actuator such that, in one or more orientations of the actuator, the gravity operated actuator adopts its second state under the influence of gravity to prevent said actuator from being retracted.

12. The coupler as claimed in claim 1, wherein the gravity operated valve is incorporated into the extend line of the hydraulic circuit for operating the actuator such that, in one or more orientations of the actuator, the gravity operated actuator adopts its second state under the influence of gravity to prevent said actuator from being retracted.

13. The coupler as claimed in claim 1, further comprising a control system for the actuator, said control system comprising a source of pressurised fluid, such as a pump, a low pressure drain or reservoir, and a switch over valve, or other switching means, being operable between a first state, wherein said source of pressurised fluid is connected to an extend line connected to an extend side of the actuator to extend the actuator, and a second state, wherein pressurised fluid is supplied to a retract line connected to a retract side of the actuator to retract the actuator, said retract line being connected to said low pressure drain or reservoir when the switch over valve, or other switching means, is in its first state and said extend line being connected to said low pressure drain or reservoir when the switch over valve, or other switching means, is in its second state.

14. The coupler as claimed in claim 13, wherein said gravity operated non-return valve is provided in or is associated with said retract line whereby the valve prevents fluid from flowing through the retract line to retract side of the actuator when the switch over valve, or other switching means, is in its second state and when the gravity operated valve is in its second state, thus preventing retraction of the actuator when the coupling is in a working orientation.

15. The coupler as claimed in claim 13, wherein said gravity operated valve is provided in or is associated with said extend line whereby the valve prevents a return flow of fluid through the extend line to the low pressure drain or reservoir when the switch over valve, or other switching means, is in its second state and when the gravity operated valve is in its second state, thus preventing retraction of the actuator when the coupling is in a working orientation by preventing the escape of fluid from the extend side of the actuator as pressurised fluid is supplied to the retract side of the actuator.

* * * * *